US005937872A

United States Patent [19]

Wang

[11] Patent Number: 5,937,872

[45] Date of Patent: Aug. 17, 1999

[54] FOLDABLE HAIR HOLDER

[76] Inventor: Hsien Chu Wang, No. 27, Ping Sha, Ping Sha Village, Chiang Jiun Hsiang, Tainan Hsien, Taiwan

[21] Appl. No.: 09/246,677

[22] Filed: Feb. 8, 1999

[51] Int. Cl.[6] ..... A45D 8/36

[52] U.S. Cl. ..... 132/273; 132/275; 2/174; 2/171

[58] Field of Search ..... 132/273, 274, 132/275, 276, 277, 141, 144; 2/171, 174, 181, DIG. 11, 182.6; D28/33, 39, 41; 24/615, 616, 625

[56] References Cited

U.S. PATENT DOCUMENTS

| | | | |
|---|---|---|---|
| D. 379,028 | 5/1997 | Young | D28/41 |
| D. 380,865 | 7/1997 | Shing | D28/41 |
| 2,171,019 | 8/1939 | Zupnyk | 132/273 |
| 3,211,160 | 10/1965 | Miller | 2/171 |
| 5,427,123 | 6/1995 | Odenthal | 132/275 |
| 5,449,008 | 9/1995 | Yeh | 132/273 |
| 5,692,243 | 12/1997 | Chang | 2/171 |
| 5,697,386 | 12/1997 | Chang | 132/273 |
| 5,822,798 | 10/1998 | Baxley | 2/182.6 |
| 5,826,597 | 10/1998 | Chou | 132/273 |

*Primary Examiner*—Gene Mancene
*Assistant Examiner*—Pedro Philogene
*Attorney, Agent, or Firm*—Charles E. Baxley, Esq.

[57] ABSTRACT

A hair holder includes an arcuate main body having two engaging ends each having a slot defined by two lateral sides. A connecting rod is extended between the lateral sides. Two side members are releasably connected to the engaging ends of the main body, respectively. Each side member includes a first end having an engaging stub projected therefrom and a second end. The engaging stub includes a root end connected to the side member and a distal end. The root end includes a recessed section with a retaining edge. The distal end includes an engaging notch defined therein and an abutting section. Each engaging stub is releasably and pivotally engaged with an associated engaging end. The engaging notch receives the connecting rod and allows pivotal movement of the engaging stub between an extended position and a folded position relative to the connecting rod.

7 Claims, 7 Drawing Sheets

FOLDABLE HAIR HOLDER

BACKGROUND OF THE INVENTION

1. Field of the Invention

The present invention relates to a foldable hair holder that is secure after assembly, convenient to use, and provides a comfortable use.

2. Description of the Related Art

A hair holder is commonly used by women and generally formed by means of heating and bending plastic material to form a shape to fit the contour of the user's head. However, the shape of the hair holder is fixed and is thus inconvenient to carriage or storage when not in use. FIG. 8 of the drawings illustrates an improved hair holder that includes an arcuate main body 1' having a receptacle 11' defined in each of two ends; thereof, two side members 2', and two hinge means 3' for connecting the side members 2' to the two ends of the main body 1', respectively. Each hinge means 3' includes two hinge plates 31' and 32' connected by a rivet 33', wherein the hinge plate 31' is received in the receptacle 11' of the main body 1, while the hinge plate 32' is received in a receptacle 21' of the side member 2'. Such arrangement allows folding of the hair holder, yet the connection among the hinge means 3', the main body 1' and the side member 2' is not reliable such that disengagement is possible regardless of whether the hair holder is in an extended status or folded status. If the hinge means 3' is fixed by glue after assembly, the side members 2' are not detachable which will adversely affects the diversity of combinations between the side members 2' and the main body 1'. FIG. 9 of the drawings illustrates a padding member 4' with an engaging receptacle 41' attached to an end of an integrally formed substantially U-shaped hair holder (not labeled) to provide increased comfort during use, yet the padding member 4' must be fixed by glue to avoid disengagement from the hair holder which also adversely affects the diversity of combinations between the hair holder and the padding member 4'. More specifically, the hair holder cannot be used with padding members of different colors and/or shapes.

The present invention is intended to provide an improved hair holder that mitigates and or obviates the above-mentioned drawbacks.

SUMMARY OF THE INVENTION

In accordance with one aspect of the invention, a hair holder comprises:

an arcuate main body having two engaging ends each having a slot defined by two lateral sides, a connecting rod being extended between the lateral sides, the slot further including a first abutting face defined in a first end thereof and a second abutting face defined in a second end thereof; and two side members releasably connected to the engaging ends of the main body, respectively, each said side member including a first end having an engaging stub projected therefrom and a second end, the engaging stub including a root end connected to the side member and a distal end, the root end including a recessed section with a retaining edge, the distal end including an engaging notch defined therein and an abutting section;

each said engaging stub being releasably and pivotally engaged with an associated said engaging end, wherein the engaging notch receives the connecting rod and allows pivotal movement of the engaging stub between an extended position and a folded position relative to the connecting rod, and wherein when the engaging stub is in the extended position, the abutting section of the engaging stub bears against the first abutting face of an associated said slot while the retaining edge of the recessed section bears against the second abutting face of the associated slot.

The engaging stub is disengagable from the connecting rod when the engaging stub is at an angle with the connecting rod, while the engaging stub is neither in the extended position nor in the folded position.

The hair holder as claimed in claim 1, wherein the engaging stub is resilient and the engaging notch includes a neck portion having a width slightly smaller than that of the connecting rod.

Each side member includes an inner side, and further comprises two padding members releasably connected to the inner sides of the side members, respectively. Each side member includes a plurality of engaging slots. Each side member further includes a protrusion on the second end thereof. Each padding member includes an outer side having a plurality of engaging blocks for releasably engaging with the engaging slots. One of the engaging slots has a third abutting face defined in an end thereof, and one of the engaging blocks has a third abutting section that bears against the third abutting face. Each padding member includes a receiving hole defined in an end thereof for receiving the protrusion of an associated side member. The inner side of the side member includes a recessed portion in which the engaging slots are defined.

In accordance with another aspect of the invention, a hair holder comprises:

an arcuate main body having two side each having a distal engaging ends, each distal said engaging end having a protrusion formed thereon and a plurality of engaging slots defined therein; and two padding members releasably engaged with the sides of the main body, each said padding member including an outer side having a plurality of engaging blocks for releasably engaging with the engaging slots, one of the engaging slots having an abutting face defined in an end thereof, one of the engaging blocks having an abutting section that bears against the abutting face, each said padding member further including a receiving hole defined in an end thereof for receiving the protrusion of an associated said side member.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
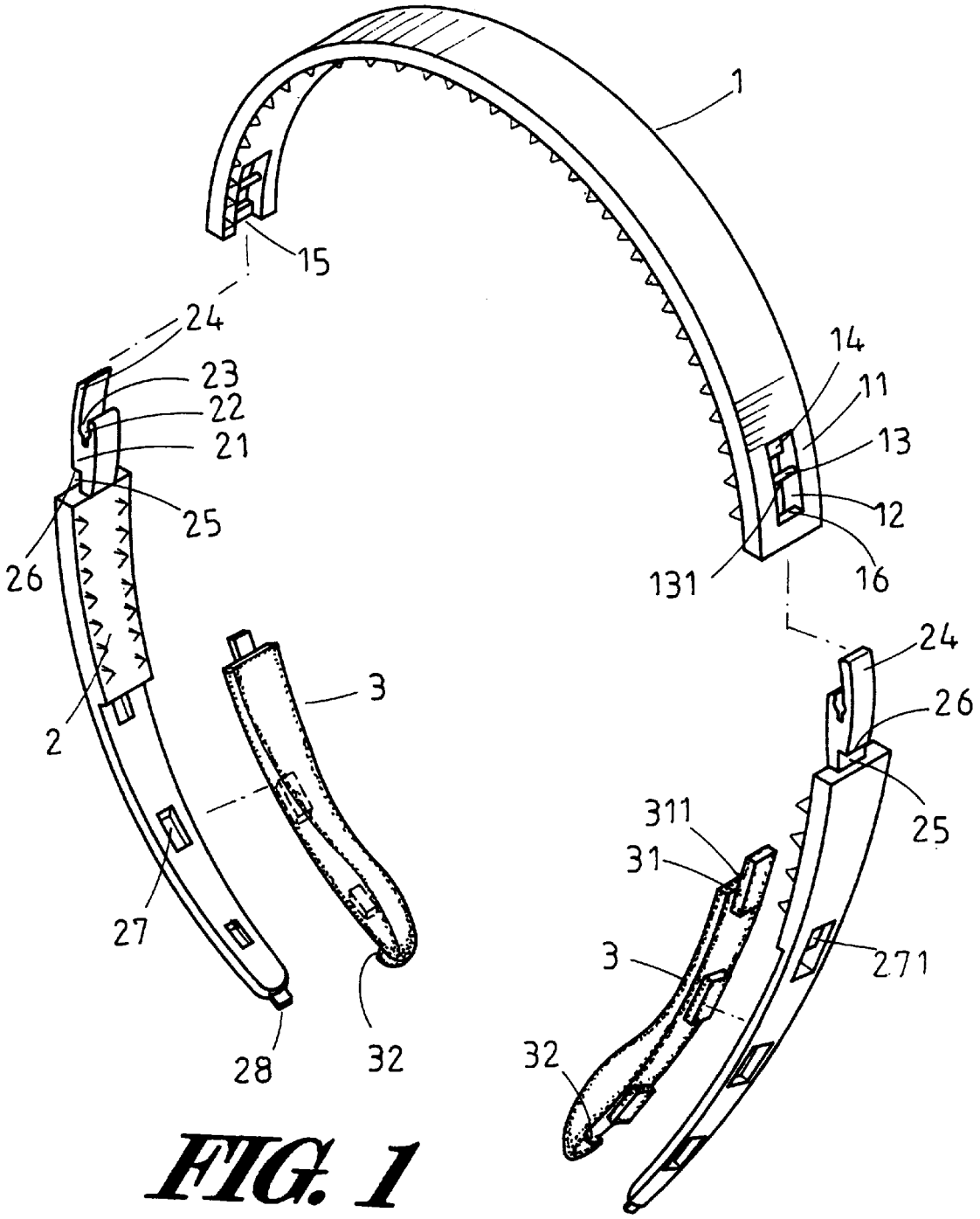
FIG. 1 is an exploded perspective view of a hair holder in accordance with the present invention.
Figure 5:
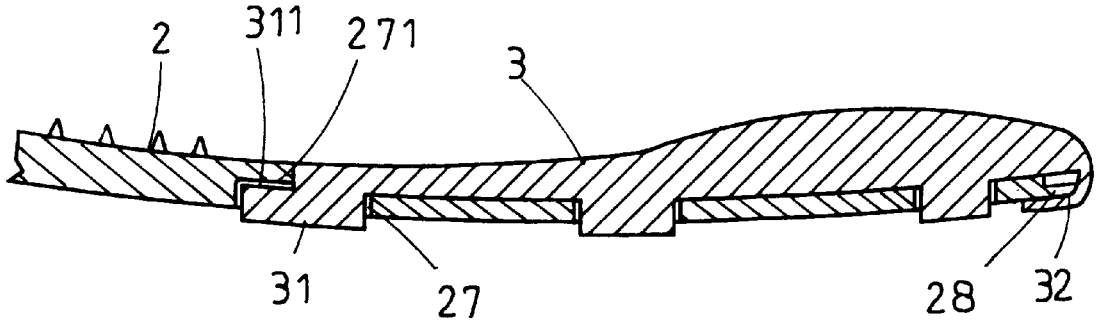
FIG. 5 is a partial sectional view of the side member and a padding member.
Figure 6:
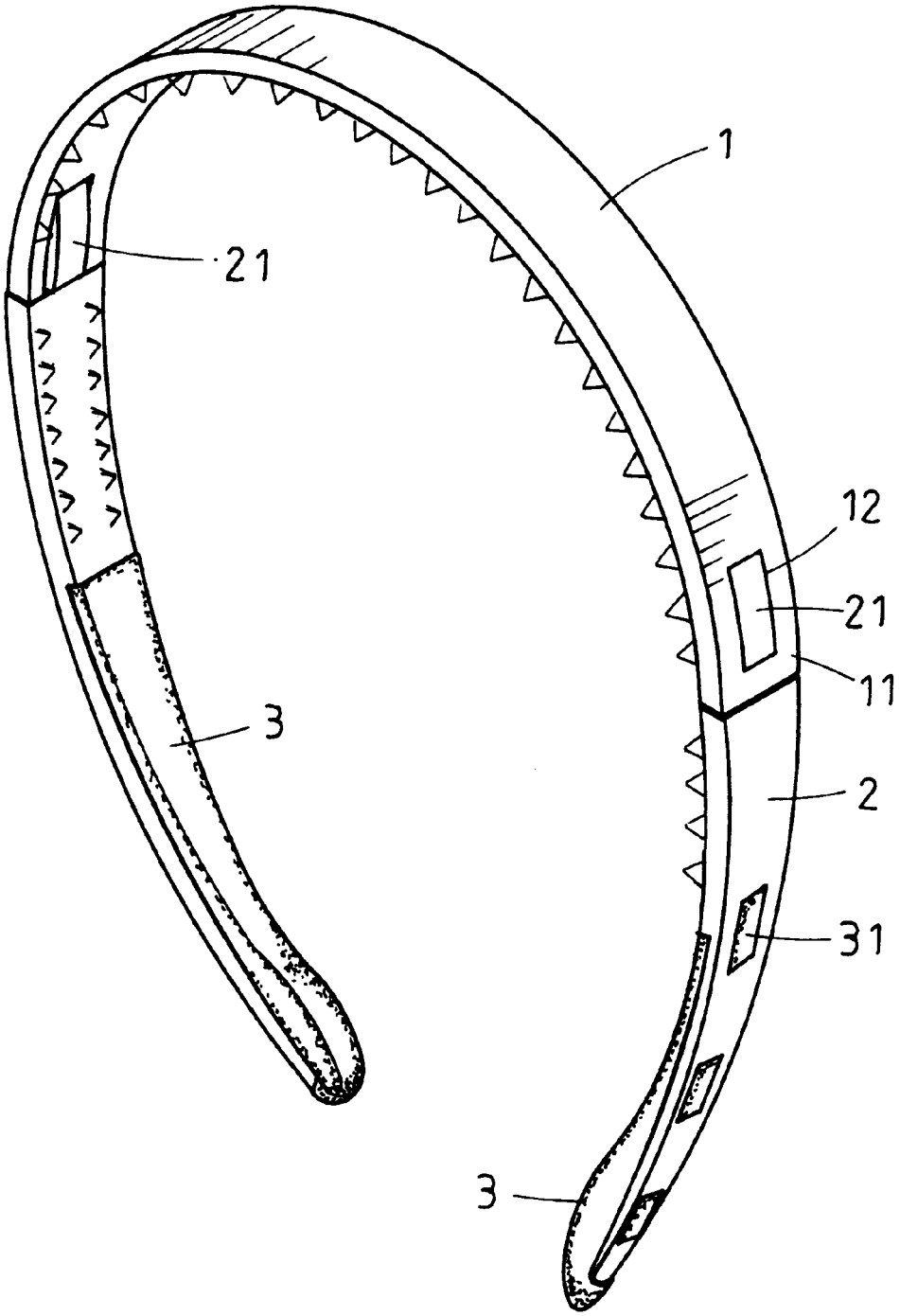
FIG. 6 is a perspective view of the hair holder in accordance with the present invention.

Referring to FIGS. 1 to 7 and initially to FIGS. 1 and 6, a hair holder in accordance with the present invention generally includes an arcuate main body 1 having two engaging ends 11, two side members 2 releasably connected to the engaging ends 11 of the main body 1, respectively, and two padding members 3 releasably connected to inner sides of the side members 2, respectively. Each engaging end 11 of the main body 1 includes a slot 12 having an abutting face 14, 16 defined in each of two ends thereof. A connecting rod 13 extends between two lateral sides that defines the slot 12. Each engaging end 11 of the main body 1 further includes a notch 15 defined in a distal portion thereof and communicated with the associated slot 12.

Still referring to FIG. 1, each side member 2 includes a first end having a resilient engaging stub 22 projected therefrom and a second end having a protrusion 28 formed thereon. Each engaging stub 22 includes a root end (not labeled) connected to the side member 2 and a distal end (not labeled). The root end includes a recessed section 25 with a retaining edge 26 defined in a first end thereof that is connected to the side member 2. Each engaging stub 21 further includes an engaging notch 22 defined in a distal end thereof. The engaging notch 22 includes a neck portion 23. In addition, each engaging stub 21 includes an abutting section 24 at the distal end thereof. Each side 131 (FIG. 2) of the connecting rod 13 is configured to allow smooth pivotal engagement with the engaging notch 21 of the associated side member 2. Each side member 2 further includes an inner side having a recessed section (not labeled) with a number of engaging slots 27 defined therein. One of the engaging slots 27 has an abutting face 27 defined therein.

Each padding member 3, made of plastic material, includes a number of engaging blocks 31 formed on an outer side thereof for engaging with the engaging slots 27 of the associated side member 2, respectively. One of the engaging blocks 31 formed on a first end of the padding member 3 includes an extension 311 extended beyond the padding member 3. In addition each padding member 3 further includes a receiving hole 32 defined in a second end thereof for releasably engaging with the protrusion 28 of the associated side member 2.

Figure 2:
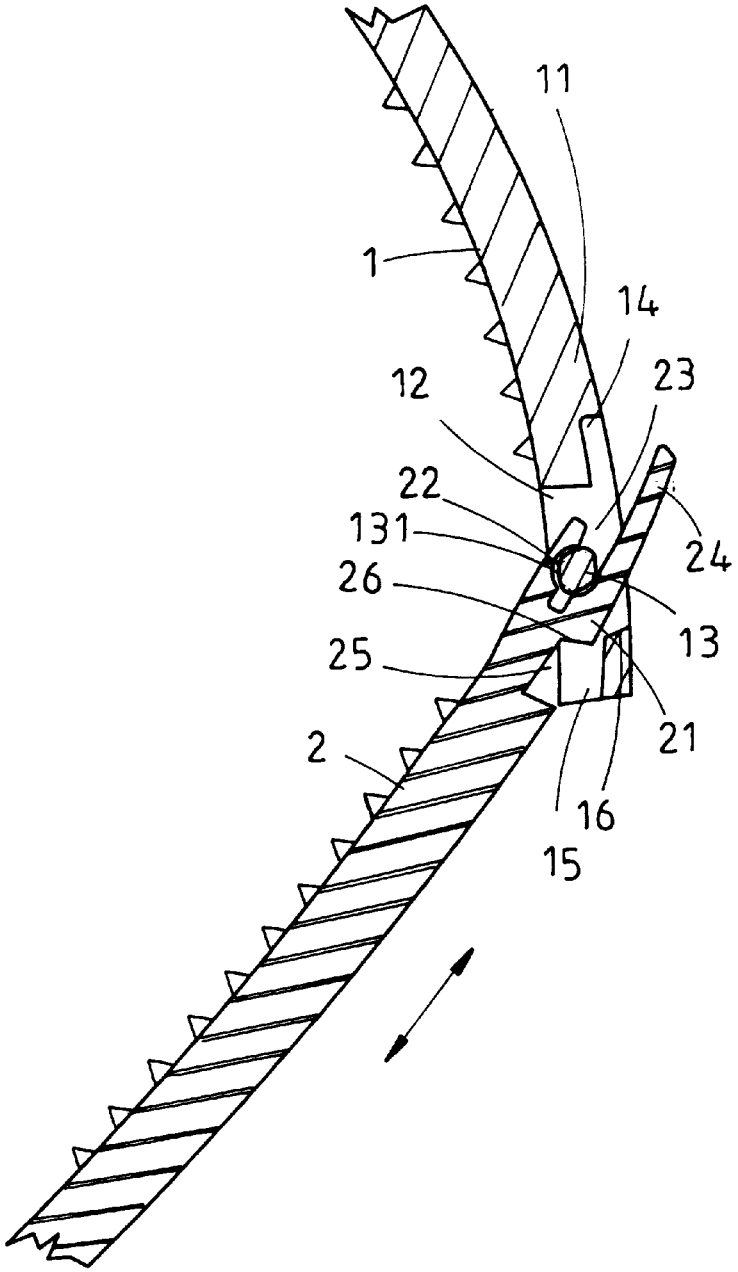
FIG. 2 is a partial sectional view, at an enlarged scale, illustrating assembly of a side member to a main body of the hair holder in accordance with the present invention.
Figure 3:
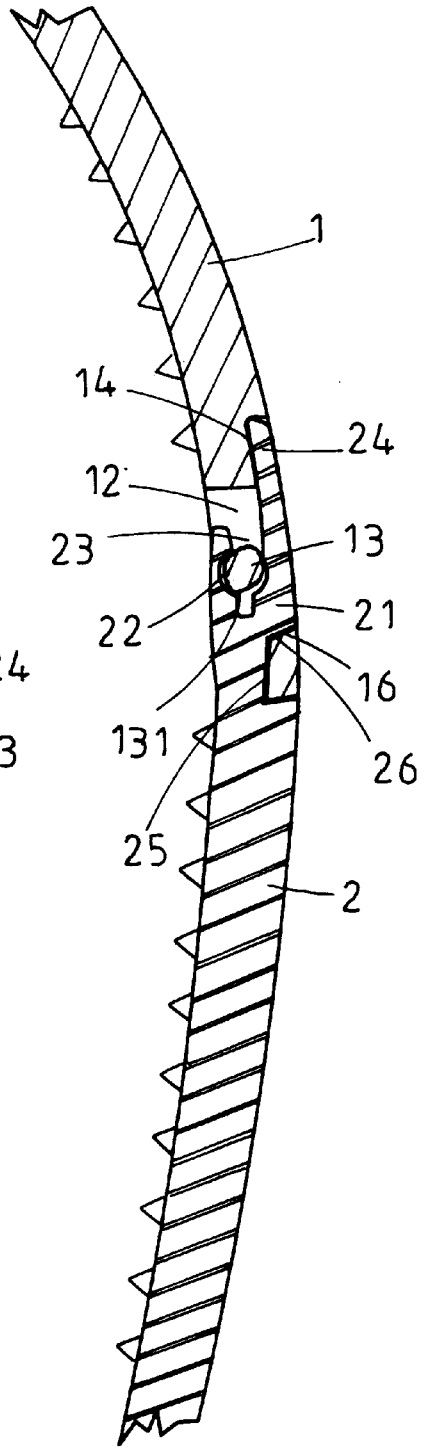
FIG. 3 is a partial sectional view of the side member and the main body in an extended status.
Figure 4:
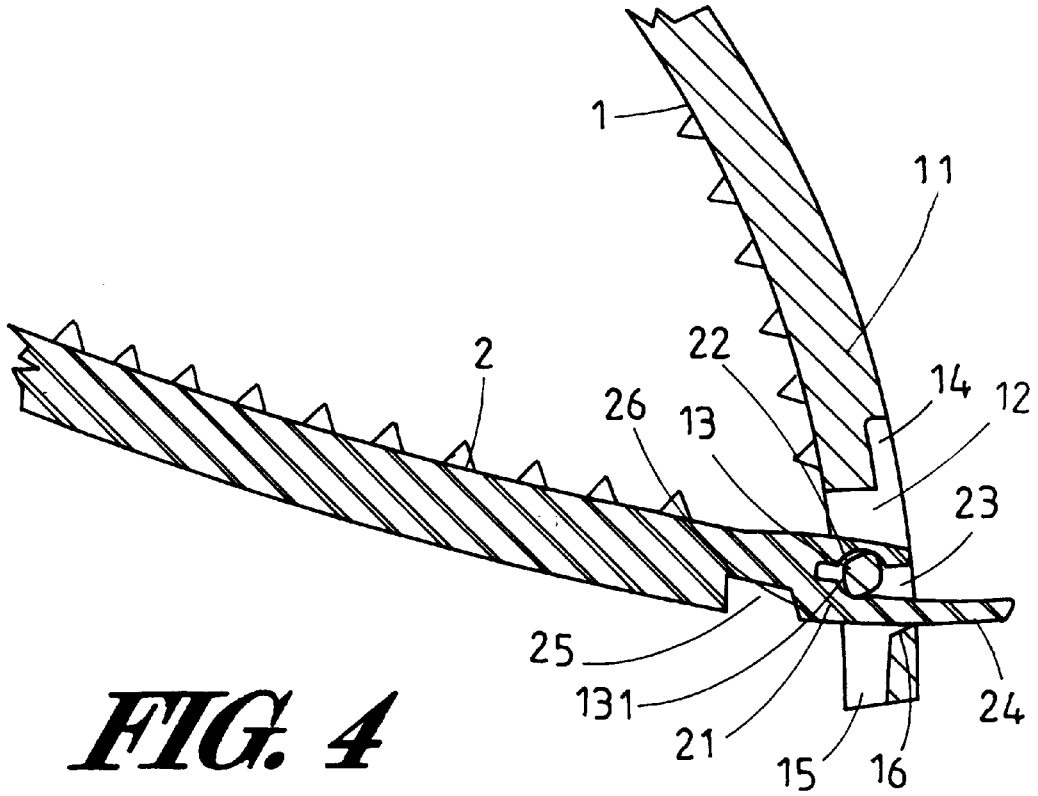
FIG. 4 is a partial sectional view of the side member and the main body in a folded status.

In assembly of the side member 2 to the main body 1, as can be seen from FIG. 2, the engaging stub 22 is inserted into the slot 11 of the associated engaging end 11 of the main body 1. The engaging notch 22 receives the connecting rod 13. The neck portion 23 has a width slightly smaller than that of the associated connecting rod 13. Thus, the neck portion 23 of the engaging notch 22 prevents disengagement of the connecting rod 13 from the engaging notch 22 unless a relatively large force is applied to pull the side member 2 away from the main body 1. The side member 2 and the main body 1 in FIG. 2 are in a pivotable engaged status. When in use, the side member 2 may be pivoted to an extended status shown in FIG. 3, wherein the abutting section 24 bears against the abutting face 14, while the retaining edge 26 of the recessed section 25 bears against the abutting face 16. When not in use, the side member 2 may be pivoted to a folded status shown in FIG. 4.

Referring to FIG. 5, in assembly of the padding member 3 and the side member 2, the extension 311 of the padding member 3 is first extended through the leftmost engaging slot 27 (from the direction of FIG. 5). Then, the padding member 3 is moved toward the side member until each engaging block 31 is received in an associated engaging slot 27, and the protrusion 28 is received in the receiving hole 32. In addition, the extension 311 of the engaging block 31 bears against the abutting face 271 of the associated engaging slot 27.

Figure 7:
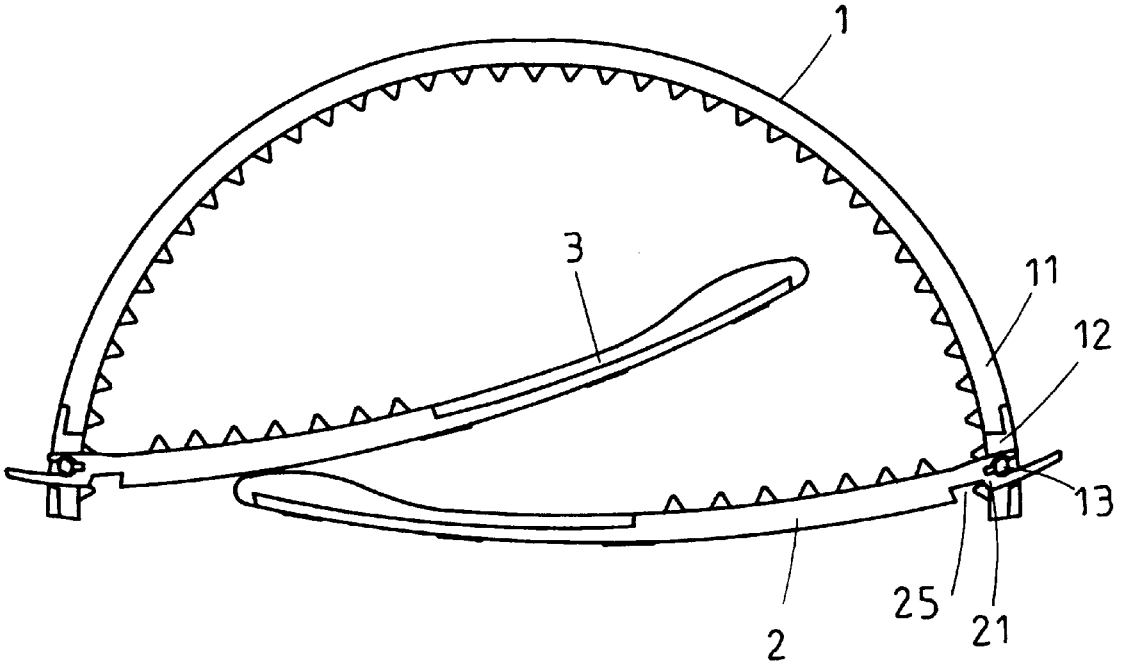
FIG. 7 is a side view of the hair holder in accordance with the present invention in a folded status.
Figure 8:
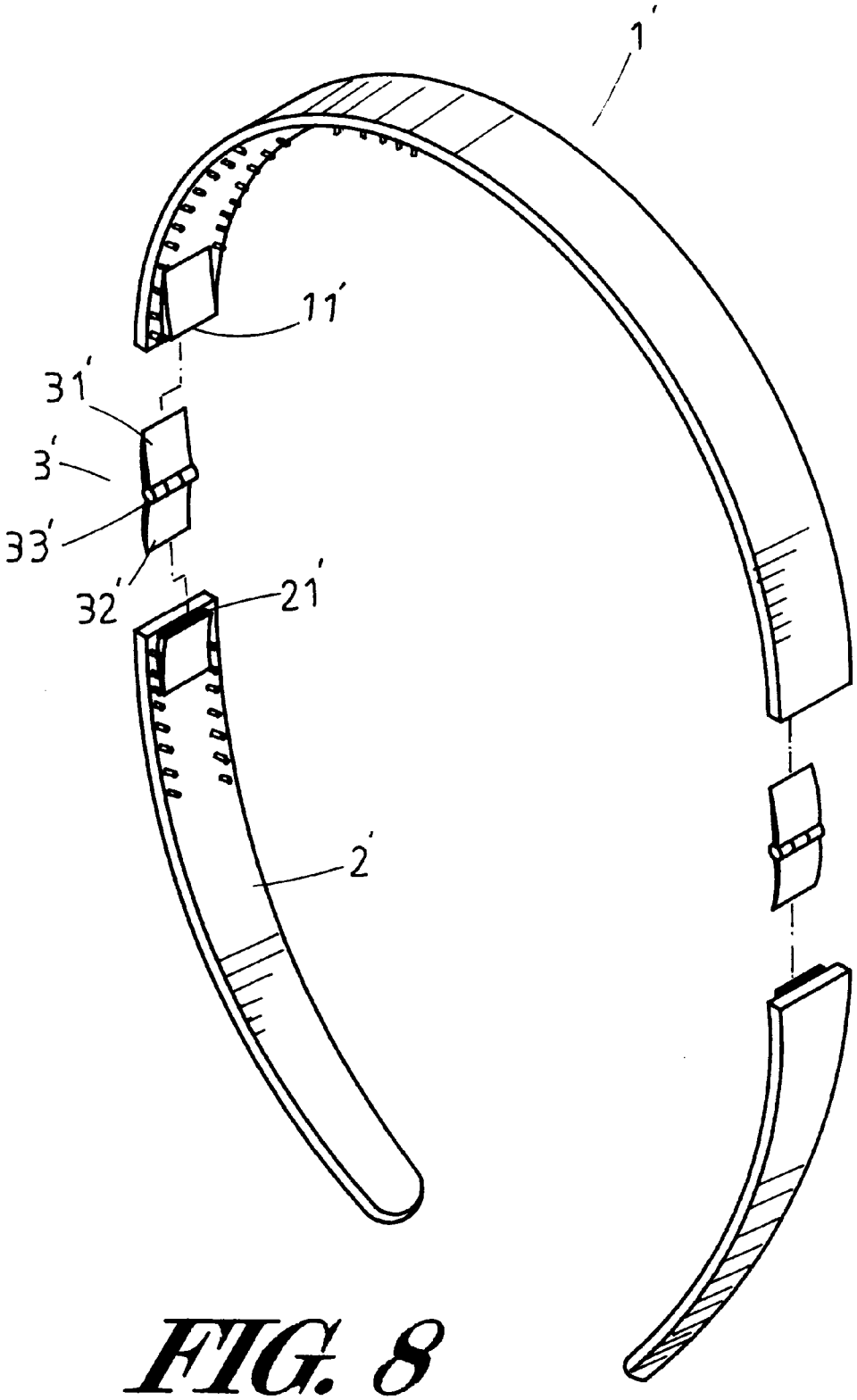
FIG. 8 PRIOR ART
FIG. 8 is an exploded perspective view of a conventional hair holder.
Figure 9:
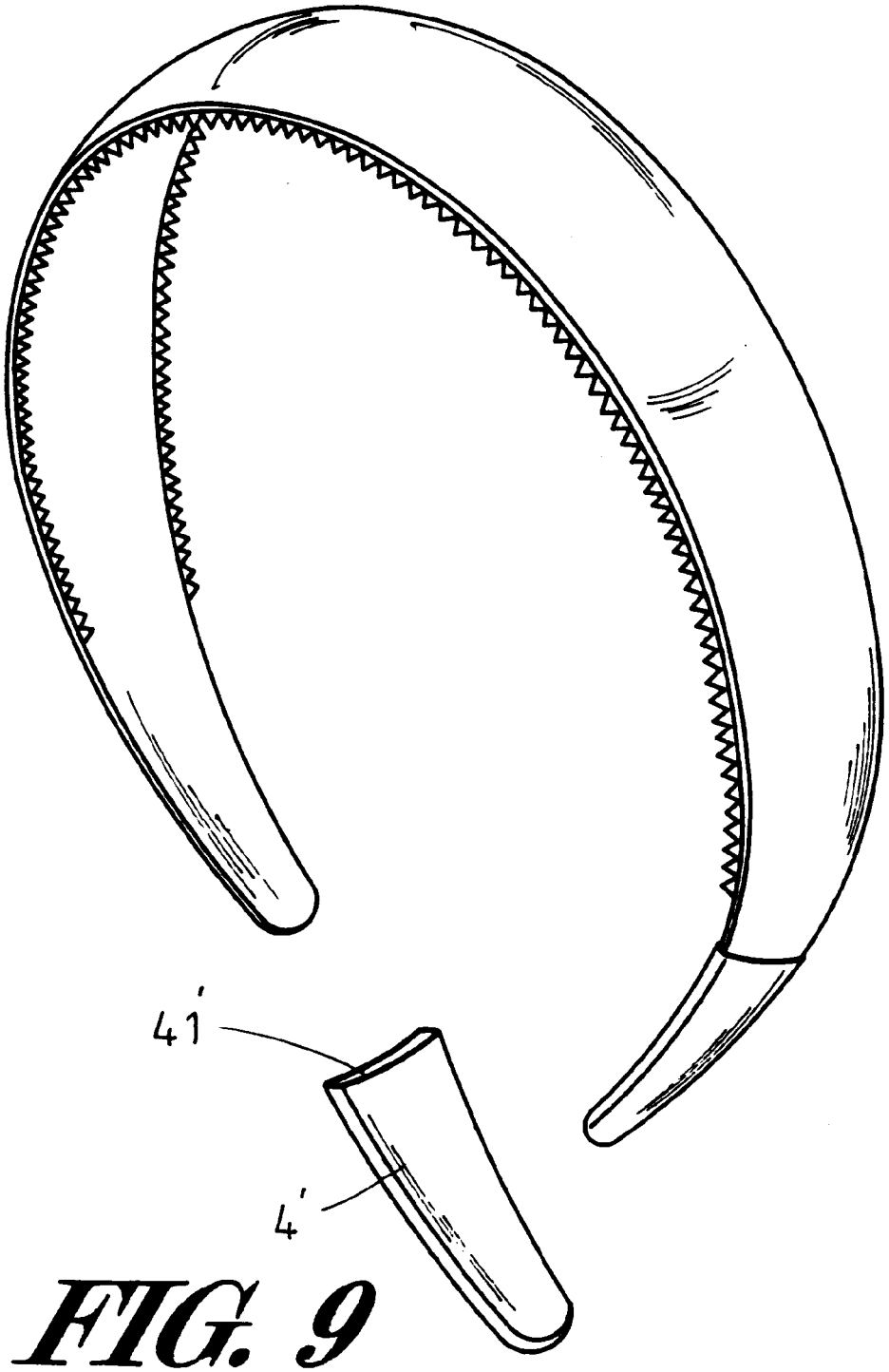
FIG. 9 PRIOR ART
FIG. 9 is a perspective view, partially exploded, of a conventional hair holder with two padding members.

The hair holder in FIG. 6 is in an extended status ready for use, and when not in use, the hair holder may be folded to a status shown in FIG. 7 for easy carriage and storage.

Engagement between the side members 2 and the main body 1 is reliable without the use of hinge means. Yet, the side members 2 are detachable from the main body 1 to allow a change in the combinations of the main body 1 and the side members 2. Disengagement of the side member 2 from the main body 1 is allowed only when the side member 2 is at a specific angle shown in FIG. 2, which is neither the extended status nor the folded status. Engagement between the side members 2 and the padding members 3 is also reliable. Yet, the padding members 3 are detachable from the side members 2 to allow a change in the combinations of the padding members 3 and the side members 2. After assembly, as can be seen from FIG. 6, the whole hair holder is streamlined to provide an aesthetic outline.

Although the invention has been explained in relation to its preferred embodiment, it is to be understood that many other possible modifications and variations can be made without departing from the spirit and scope of the invention as hereinafter claimed.

What is claimed is:

1. A hair holder comprising:

an arcuate main body having two engaging ends each having a slot defined by two lateral sides, a connecting rod being extended between the lateral sides, the slot further including a first abutting face defined in a first end thereof and a second abutting face defined in a second end thereof; and two side members releasably connected to the engaging ends of the main body, respectively, each said side member including a first end having an engaging stub projected therefrom and a second end, the engaging stub including a root end connected to the side member and a distal end, the root end including a recessed section with a retaining edge, the distal end including an engaging notch defined therein and an abutting section;

each said engaging stub being releasably and pivotally engaged with an associated said engaging end, wherein the engaging notch receives the connecting rod and allows pivotal movement of the engaging stub between an extended position and a folded position relative to the connecting rod, and wherein when the engaging stub is in the extended position, the abutting section of the engaging stub bears against the first abutting face of an associated said slot while the retaining edge of the recessed section bears against the second abutting face of the associated slot.

2. The hair holder as claimed in claim 1, wherein the engaging stub is disengagable from the connecting rod when the engaging stub is at an angle with the connecting rod, while the engaging stub is neither in the extended position nor in the folded position.

3. The hair holder as claimed in claim 1, wherein the engaging stub is resilient and the engaging notch includes a neck portion having a width slightly smaller than that of the connecting rod.

4. The hair holder as claimed in claim 1, wherein each said side member includes an inner side, and further comprises two padding members releasably connected to the inner sides of the side members, respectively.

5. The hair holder as claimed in claim 4, wherein each said side member includes a plurality of engaging slots, each said side member further includes a protrusion on the second end thereof, each said padding member includes an outer side having a plurality of engaging blocks for releasably engaging with the engaging slots, wherein one of the engaging slots has a third abutting face defined in an end thereof, and one of the engaging blocks has a third abutting section that bears against the third abutting face, and wherein each said padding member includes a receiving hole defined in an end thereof for receiving the protrusion of an associated said side member.

6. The hair holder as claimed in claim 5, wherein the side member includes an inner side with a recessed portion in which the engaging slots are defined.

7. A hair holder comprising:

an arcuate main body having two side each having a distal engaging ends, each distal said engaging end having a protrusion formed thereon and a plurality of engaging slots defined therein; and two padding members releasably engaged with the sides of the main body, each said padding member including an outer side having a plurality of engaging blocks for releasably engaging with the engaging slots, one of the engaging slots having an abutting face defined in an end thereof, one of the engaging blocks having an abutting section that bears against the abutting face, each said padding member further including a receiving hole defined in an end thereof for receiving the protrusion of an associated said side member.

* * * * *